United States Patent [19]

Bensinger

[11] Patent Number: 4,932,548

[45] Date of Patent: Jun. 12, 1990

[54] SPACE DIVIDER ASSEMBLY FOR A FREEZER CHEST

[76] Inventor: Jennifer H. Bensinger, 6970 Dexter-Pinckney Rd., Dexter, Mich. 48130

[21] Appl. No.: 408,895

[22] Filed: Sep. 18, 1989

[51] Int. Cl.[5] ..... A65D 21/02

[52] U.S. Cl. ..... 220/21; 220/22; 220/22.3; 206/509

[58] Field of Search ..... 220/21, 22, 22.5, DIG. 15, 220/DIG. 6; 206/509, 427

[56] References Cited

U.S. PATENT DOCUMENTS

| | | | |
|---|---|---|---|
| 1,493,805 | 5/1924 | Chitwood | 220/21 |
| 2,199,740 | 5/1940 | Carney | 220/21 |
| 3,656,650 | 4/1972 | Frater | 220/21 |
| 4,190,172 | 2/1980 | Box | 220/21 |
| 4,499,997 | 2/1985 | Swingley, Jr. | 206/509 |
| 4,635,810 | 1/1987 | Tate | 220/22 |
| 4,703,855 | 11/1987 | Moe et al. | 220/21 |

*Primary Examiner*—Joseph Man-Fu Moy

*Attorney, Agent, or Firm*—Harness, Dickey & Pierce

[57] ABSTRACT

In a freezer chest, a space divider assembly is provided to organize the space within the freezer compartment. The space divider assembly has an end panel with upright tracks securably attached within the freezer compartment. Divider panels are mounted in the tracks, each of the panels having slots extending approximately half its length wherein other divider panels are slidably attached. The other divider panels also have slots which enable the panels to be assembled in crisscross fashion. When assembled the panels divide the freezer compartment into a plurality of storage columns arranged in a checkerboard pattern.

5 Claims, 2 Drawing Sheets

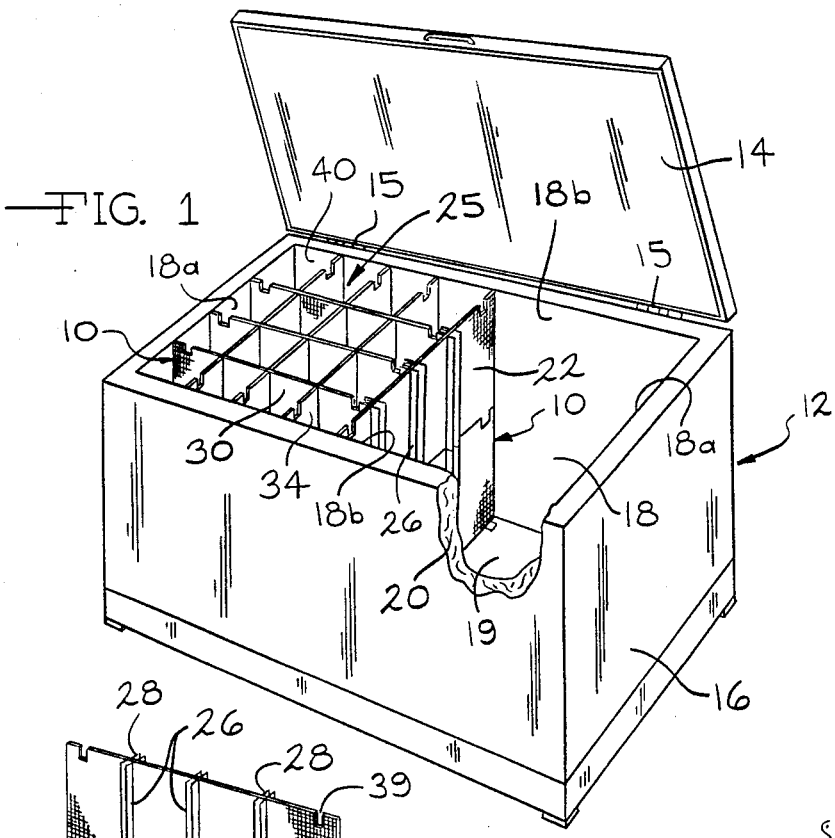
FIG. 1
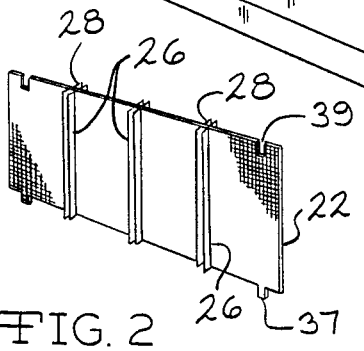
FIG. 2
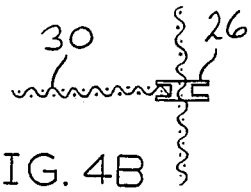
FIG. 4B
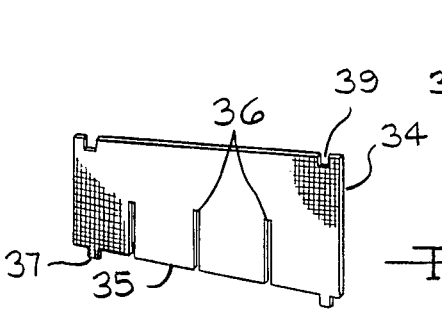
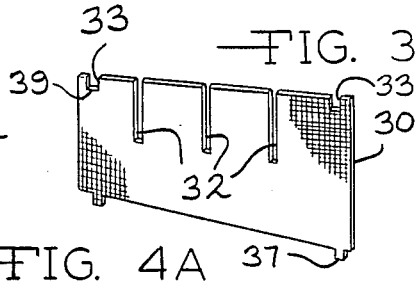
FIG. 3
FIG. 4A

SPACE DIVIDER ASSEMBLY FOR A FREEZER CHEST

BACKGROUND AND SUMMARY OF THE INVENTION

This invention relates generally to the problem of organizing freezer space and more particularly to a space divider assembly that can be installed in an existing freezer chest to enable organized storage of a variety of frozen products.

Since most homes have limited freezer space, it is a desirable objective to organize the space within the freezer as efficiently as possible. Presently, there is no provision in freezers for organizing the interior space. Consequently, items stored within a freezer tend to become disorganized and take up more space than necessary.

To alleviate this situation, a space divider for a freezer chest is provided. The space divider of this invention has an end panel which is inserted in the interior of the freezer so as to define a storage cavity within the freezer compartment. The end panel has at least one track designed to receive and support at least one divider panel in an insert dimensioned to fit within the cavity.

The insert consists of a plurality of upright divider panels arranged crisscross fashion with some of the panels being perpendicular to others. The result, when the insert is placed in the cavity, is a division of the cavity by the panels into a plurality of upright storage columns arranged in a checkerboard pattern to thereby facilitate storage of a variety of frozen products in a organized manner in the freezer.

The invention provides for the organized storage of like or similar items and enables effective rotation of foods according to date and/or frequency of use. The invention provides for maximum use of limited space and provides for more complete freezing of frozen food items.

The invention consists of three different panels which are easily manufactured in different sizes to make use of a full or partial depth cavity in the freezer compartment. The storage columns in the freezer cavity can be of a size to accommodate various needs.

It is therefore an object of the present invention to provide an insert for a freezer compartment which provides for organized storage of items within the freezer.

It is a further object of the present invention to provide a flexible system which enables maximum use of limited space within the freezer chest and allows the freezer compartment to be customized to the particular needs of the user.

Further objects, features and advantages of this invention will become apparent from a consideration of the following description, the appended claims and the accompanying drawings.

BRIEF DESCRIPTION OF THE DRAWINGS

FIG. 1 is a perspective view of a freezer chest showing one embodiment of the space divider assembly of this invention installed in the freezer compartment;

FIG. 2 is a perspective view of the end panel in the space divider assembly of this invention;

FIGS. 3 and 4A are perspective views of the divider panels in the space divider assembly;

FIG. 4B is a fragmentary plan view of a portion of the space divider assembly.

DESCRIPTION OF THE PREFERRED EMBODIMENT

Figure 5:
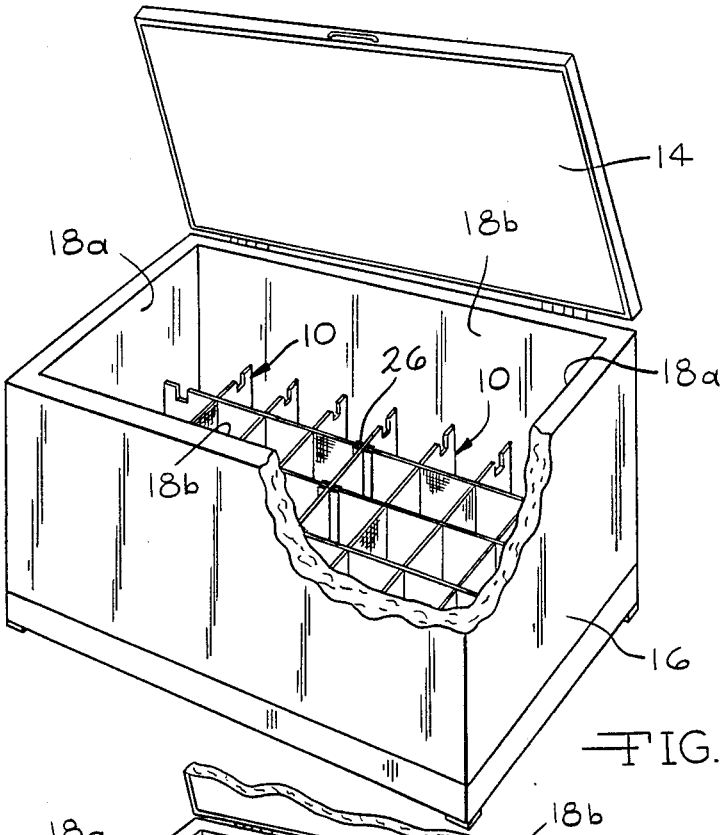
FIGS. 5 and 6 are perspective views of other embodiments of the invention.

With reference to the drawing, FIG. 1 shows one embodiment of this invention in which two space divider assemblies, each designated by the numeral 10, are assembled one on top the other within a freezer chest 12. The freezer chest 12 has a top opening door 14 attached by hinges 15 to the freezer body 16 which contains the freezer compartment 18. The compartment 18 is of generally oblong shape having end walls **18*a* and sidewalls 18*b*, and a bottom wall 19**.

The freezer 12 is made of an insulating material 20 to maintain the desired temperature within the freezer compartment 18. While the preferred embodiment is being described in connection with a top opening chest-type freezer, it is within the purview of the invention to use the space divider assembly 10 with other style freezers.

The space divider assembly 10 includes an end panel 22 which extends between the sides **18*b* of the freezer compartment 18. The assemblies 10 are positioned in the compartment 18 so as to partition off a substantially square cavity 25 in the compartment 18. The end panel 22 also has a plurality of straight vertically extending U-shaped tracks 26 extending parallel with the sides 18*b* of the freezer compartment 18. The tracks 26 have open upper ends 28** for a purpose to appear presently.

The space divider assembly 10 also includes upright divider panels 30 (FIG. 3) which extend perpendicularly between one end wall **18*a* and the end panel 22 and are slidably secured within the tracks 26. Each divider panel 30 also has a plurality of vertical slots 32 which extend downwardly from the upper end 33 of the panel to approximately half the upright length of the panel 30**.

The slots 32 in the divider panel 30 are of a size to slidably accept divider panels 34 (FIG. 4) which are inserted therein. The divider panel 34 also has slots 36 extending from its lower end 35 which correspond to the slots 32 in the divider panel 30. The panels 34 are of a length to extend between the compartment side walls **18*b* and are assembled with the panels 30 by interlocking the slots in each panel 34 with three of the perpendicular panels 30. Similarly each panel 30 has its three slots interlocked with three panels 34**.

The end panel 22 and the plurality of upright divider panels 30 and 34 arranged crisscross fashion, as shown in FIG. 1, form a divider assembly 10 movable downwardly through the open upper end of the compartment 18 into the cavity 25. During such movement the panels 30 are directed into the open upper ends 28 of the tracks 26 and are then moved downwardly in the tracks 26. The panels 30 extend between the panel 22 and one end wall **18*a* and the panels 34 extend between the side walls 18*b* so as to divide the cavity 25 into a plurality of upright storage columns 40 arranged in a checkerboard pattern to thereby facilitate storage of a variety of frozen products in an organized manner in the freezer compartment 18**.

In the embodiment illustrated in FIG. 1, two assemblies 10 are stacked one on top the other with the upper assembly 10 having downwardly extending legs 37 which fit in notches 39 in the lower assembly 10 to facilitate stacking. The two stacked assemblies 10 are of the same vertical height as the compartment 18 in the preferred embodiment of the invention. However, only a single assembly can be used, if space above the assembly 10 is desired for other uses. Moreover, the space divider assembly 10 may be used within the freezer compartment 18 to fully compartmentalize the compartment or only a portion of the compartment 18, as desired.

Figure 6:
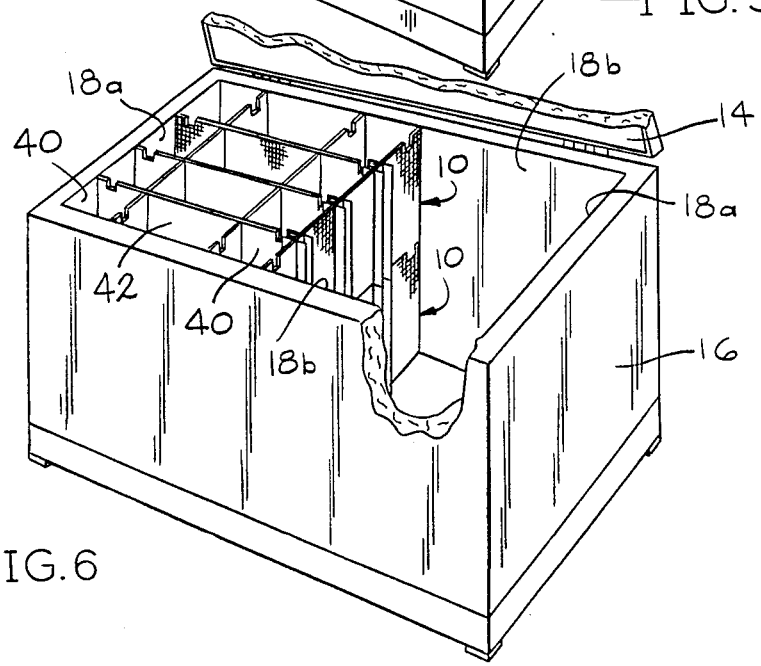

The space divider assembly 10 can also be readily removed for such purposes as sink or dishwasher cleaning of the panels 22, 30 and 34 or to clean the compartment 18. It is intended that the stored items will be stacked vertically in the columns 40 to provide maximum use of the limited freezer space and effective organization of foods according to date and frequency of use. In one embodiment, shown in FIG. 6, fewer slots 32 and 36 are provided in the panels 30 and 34, respectively, to allow the adaptation of compartment sizes to accommodate different size items. As shown in FIG. 6, the columns 42 are larger in size than the columns 40. The space divider assembly 10 is structured to be easily placed into any existing freezer 12 or may be sold with the freezer 12. In the embodiment shown in FIG. 5, the space divider assemblies 10 are arranged side-by-side on the bottom wall 19 of the compartment 18. This enables the storage of larger and irregularly shaped objects on top the divider assemblies 10.

From the above description, it is seen that this invention provides a space divider assembly for a freezer chest which institutes a clear, organized storage for maximum use of the limited space within the freezer cavity. While the invention has been described in conjunction with specific embodiments thereof, it is evident that many alternatives, modifications and variations will become apparent to those skilled in the art in light of the foregoing description. Accordingly, it is intended to embrace all such alternatives, modifications and variations that fall within the spirit of the broad scope of the appended claims.

What is claimed is:

1. A space divider assembly for a storage compartment of generally rectangular shape in a freezer chest wherein said compartment has upright substantially planar end and side walls, a bottom wall and an open top end, said divider assembly comprising:

(a) an end panel extending between said side walls so as to form within said compartment a storage cavity bounded by said compartment side walls, one of said compartment end walls and said end panel;

(b) a plurality of upright tracks on said end panel at positions facing said one end wall;

(c) a plurality of first upright divider panels located within said storage compartment and extending between said end wall and said end panel, said divider panels being supported in said track portions so that said divider panels are maintained in upright predetermined positions, each of said divider panels having an upper portion with a plurality of upright slots formed therein so as to be open at their upper ends;

(d) a plurality of second upright divider panels in said cavity extending between said compartment sidewalls, each of said second panels having slots corresponding to said first panel slots, unslotted portions of each of said second panels being inserted in said slots in said first panels and unslotted portions of each of said first panels being received in said slots in said second panels to thereby divide said cavity into a plurality of upright storage columns arranged in a checkerboard pattern.

2. The space divider assembly of claim 1 wherein a pair of said assemblies are arranged side-by-side on said bottom wall of said compartment at a position below the upper end of said compartment.

3. The space divider assembly of claim 1 wherein a pair of said assemblies are stacked one on top the other in said compartment in said storage cavity.

4. The space divider assembly of claim 3 wherein coacting means in the form of interfitting leg and notches are formed on said pair of assemblies to facilitate said stacking.

5. A space divider assembly for a storage compartment of generally rectangular shape in a freezer chest wherein said compartment has upright substantially planar end and side walls, a bottom wall and an open top end, said divider assembly comprising:

(a) an end panel attached to and extending between said side walls so as to form within said compartment a storage cavity bounded by said compartment side walls, one of said compartment end walls and said end panel;

(b) a plurality of upright tracks on said end panel at positions facing said one end wall; and (c) a plurality of upright divider panels mounted on said end panel and arranged crisscross fashion with some of said divider panels being substantially perpendicular to others of said divider panels, said panels being dimensioned so as to form said divider assembly so that it is movable as a unit downwardly through the open upper end of said compartment into said cavity, thereby dividing said cavity into a plurality of upright storage columns arranged in a checkerboard pattern to facilitate storage of a variety of frozen products in an organized manner in the freezer.

* * * * *